US006033497A

United States Patent [19]

Ryan et al.

[11] Patent Number: 6,033,497

[45] Date of Patent: Mar. 7, 2000

[54] PITTING RESISTANT DUPLEX STAINLESS STEEL ALLOY WITH IMPROVED MACHINABILITY AND METHOD OF MAKING THEREOF

[75] Inventors: Edward R. Ryan, Huron; John C. Rogers, Sandusky, both of Ohio

[73] Assignee: Sandusky International, Inc., Sandusky, Ohio

[21] Appl. No.: 09/144,310

[22] Filed: Aug. 31, 1998

Related U.S. Application Data

[60] Provisional application No. 60/058,109, Sep. 5, 1997.

[51] Int. Cl.[7] ..... C22C 38/42; C21D 9/00

[52] U.S. Cl. ..... 148/325; 148/327; 148/542; 148/548; 420/58; 420/60

[58] Field of Search ..... 148/325, 327, 148/542, 548; 420/58, 60; 164/477

[56] References Cited

U.S. PATENT DOCUMENTS 5,238,508 8/1993 Yoshitake et al. .
5,298,093 3/1994 Okamoto .
5,672,215 9/1997 Azuma et al. .

OTHER PUBLICATIONS

European Search Report on Application No. PCT/US98/18292 corresponding to this U.S. application.

Carlsson, T., PRODEC, "How to solve machining problems in chip forming operations on stainless steels", pp. 1–12, Acciaio Inossic, 53 (3), pp. 9–12, Sept–Sept. 1986.

*Primary Examiner*—Deborah Yee
*Attorney, Agent, or Firm*—Emch, Schaffer, Schaub & Porcello, Co., L.P.A.

[57] ABSTRACT

A highly pitting resistant duplex stainless steel alloy is provided which compromises in weight percentages: C: 0.10% and below; Si: 1.5% and below; Mn: 2.0% and below; Cr: 25.0% to 27.0%; Ni: 5.0% to 7.5%; Cu: 1.5% to 3.5%; N: 0.15% and below; Mo: 0.5% and below; and the remaining portion being substantially iron and unavoidable impurities. This alloy has greatly improved machinability when treated in the mold after casting by an accelerated heat treatment, as compared to the same alloy composition that is very slowly control cooled in a tightly closed heat treatment furnace.

9 Claims, No Drawings

PITTING RESISTANT DUPLEX STAINLESS STEEL ALLOY WITH IMPROVED MACHINABILITY AND METHOD OF MAKING THEREOF

RELATED APPLICATION

The present application is related to a Provisional Application Ser. No. 60/058,1090 filed Sep. 5, 1997.

TECHNICAL FIELD

This invention relates to pitting resistant duplex stainless steel alloy with improved machinability.

BACKGROUND OF THE INVENTION

The present invention relates to a duplex stainless steel that is treated by an accelerated in-mold heat treatment treated after casting without using a separate heat treatment step. The duplex stainless steel has improved machinability and retains excellent corrosion resistant properties.

Rainger et al. (U.S. Pat. Nos. 4,612,069 and 4,740,254) describe a duplex stainless steel alloy having improved pitting resistance. The alloy described in those patents as "X-6" is herein called "Alloy 86". Alloy 86 is the result of adding 2 weight percent copper to an alloy (Alloy 75) without a simultaneous addition of molybdenum. The addition of copper without molybdenum allows the duplex stainless steel alloy to be very slowly control cooled in a tightly closed heat treatment furnace so that harmful tensile residual stresses are minimized while excellent ductility and corrosion resistance were retained.

A comparative commercially available molybdenum-containing alloy is 3RE60 SRG® from Avesta Prefab. A.V. of Sweden. Typical compositions of the duplex stainless steels discussed in this application are listed in Table I below in weight percent:

TABLE I

| Alloy | Cr | Ni | Cu | Mo |
|---|---|---|---|---|
| Alloy 75 | 25.7 | 6.8 | — | — |
| Alloy 86 | 26 | 6.8 | 2.0 | — |
| X-11 | 26 | 6.8 | 2.0 | — |
| 3RE60 SRG | 18.5 | 5.0 | — | 2.8 |

Alloy 86 has useful applications in the chemical and pulp and paper manufacturing industries. The Alloy 86 can be used to make, but is not limited to, such products as vessels, retorts and piping; for paper machine roll shells such as coater rolls, grooved rolls and blind-drilled rolls; and for paper machine suction roll shell applications such as breast rolls, couch rolls, pickup rolls, press rolls and wringer rolls. These products require hundreds of hours of machining and hole-drilling time during their manufacture. The alloy X-11 of the present invention also has the same useful applications but with faster manufacturing cycle times and improved machinability and drillability.

Competitive pressures have directed metallurgical development towards duplex stainless steel alloys that have the necessary corrosion resistant properties for their end use, but can be manufactured in less time. The X-11 alloy has a desired combination of properties achieved through its chemical composition and accelerated in-mold heat treatment. Accelerated in-mold heat treatment manufacturing time by eliminating the separate heat treatment step needed by conventional alloys; by reducing machine tool setup with straighter, rounder centrifugal castings; by providing an alloy that is easier to machine and drill thereby reducing the amount of machining and drilling time needed to manufacture the product; and by reducing tool wear so that manufacturing equipment does not need to be stopped to change dull tools.

The required properties for the successful use of a duplex stainless steel alloy for suction roll shells in the pulp and paper making industries are a chemical composition that yields a duplex microstructure of austenite in a ferrite matrix, corrosion resistance in aggressive paper mill white waters, resistance to fatigue crack growth, and low residual stresses. In addition to its unique manufacturing properties, the X-11 alloy meets these service requirements.

Duplex stainless steels with intentional additions of molybdenum cannot be heat treated in the mold because the cooling rate is not fast enough to avoid the formation of embrittling and corrosion-degrading phases. An additional heat treatment step to dissolve those undesirable phases followed by a fast cooling step to prevent their reoccurrence is needed. The chemical compositions of Alloy 86 and X-11 with their copper addition for pitting resistance can tolerate much slower cooling rates and not form those brittle phases.

The machinability of duplex stainless steels is considered to be limited by their high annealed strength (Metals Handbook, Ninth Edition, pp. 689–690). Carlborg, C., Nilsson, A., and Franklind, P-A, "Machinability of Duplex Stainless Steel", Proceedings of a Conference Held in Beaune Bourgogne, France, October 1991, Vol. 1, pp. 683–696, discusses a variety of metallurgical variables such as high temperature strength, inclusions, structure and alloying elements on duplex stainless steel machinability but does not recognize the relationship of accelerated in-mold heat treatment for enhanced machinability. Charles, J., Dupoiron, F., Souglignac, P., and Gagnepain, Jr., "UR 35N Cu: A New Copper-Rich Molybdenum Free Duplex Stainless Steel with Improved Machinability, "Proceedings of a Conference Held in Beaune Bourgogne, France, October 1991, Vol. 2, pp. 1274–1281, reports that copper in a water-quenched duplex stainless steel improves machinability. However, the X-11 alloy at the same copper content as Alloy 86 has improved machinability as a result of accelerated in-mold heat treatment, which is not recognized by Charles et al.

The prior art of steel makers suggests that machinability of austenitic stainless steels can be enhanced by additions of alloying elements such as sulfur and selenium that may reduce corrosion performance (Metals Handbook Ninth Edition p. 686). Or, special steel making practices need to be implemented to control oxide inclusion composition (Metals Handbook Ninth Edition p. 688; Johansson, R., Davison, R., "Wrought Duplex Stainless Steel Suction Rolls With High Performance", 1996 TAPPI Engineering Conference Proceedings, pp. 103–109; Carsson, T., "Prodec-How to Solve Machining Problems", pp. 9–12). Neither practice is required for the X-11 alloy to have enhanced machinability and drillability.

SUMMARY OF THE INVENTION

A highly pitting resistant duplex stainless steel alloy is provided which comprises in weight percentages: C: 0.10% and below; Si: 1.5% and below; Mn: 2.0% and below; Cr: 25.0% to 27.0%; Ni: 5.0% to 7.5%; Cu: 1.5% to 3.5%; N: 0.15% and below; Mo: 0.5% and below; and the remaining portion being substantially iron and unavoidable impurities to form the material of the highly pitting resistant duplex stainless alloy. This alloy has greatly improved machinability when an accelerated heat treatment is used in the mold after casting as compared to the same alloy composition that is very slowly control cooled in a tightly closed heat treatment furnace as a separate process step.

DESCRIPTION OF PREFERRED EMBODIMENT

The process of accelerated in-mold heat treatment described herein is for a hollow cylindrical centrifugal casting, but can apply to other cast duplex stainless steel products where control of microstructure and residual stresses are important. Molten metal poured into a mold solidifies and eventually cools to ambient temperature. Prior art duplex stainless steels require that a casting be removed from its mold and be heat treated for optimum corrosion resistance in another piece of manufacturing equipment (i.e. furnace) as a separate process step. The alloy of the present invention, X-11, is unique because it is heat treated in the mold through an accelerated process, and as a result avoids a major heat treatment process step. The alloy of the present invention is made without the need for a separate furnace controlled cooling step.

The inside temperature of the cast duplex stainless steel product is kept at approximately the same temperature as the outside temperature of the cast duplex stainless steel product during cooling. Both the inside and the outside temperatures are controlled so that both temperatures slowly decrease at the same rate.

With accelerated in-mold cooling, the rate of the casting cooling is controlled in the temperature range over which the metal develops significant strength, that is approximately 260° C.–1090° C. (500° F.–2000° F.). Within this temperature range, the temperature of the inside diameter of the casting is kept within 250° C. (450° F.) of the temperature of the outside diameter of the casting by measuring the inside and outside temperatures. The rate of cooling of the inside and outside temperatures can be controlled by slowing down the cooling rate of the casting by adding heat to the inside or using thermal insulation at the mold ends; or speeding up the cooling rate by using techniques like a controlled amount of forced air, a water mist, or a water spray or other cooling media or other cooling techniques.

The time needed to accomplish the accelerated in-mold heat treatment is less than about 20 hours depending on the mass of the casting. This heat treatment time is much less when compared to the time required to heat treat Alloy 86, about 72–144 hours plus possible delays waiting for heat treat furnace availability. The accelerated in-mold heat treatment of the X-11 alloy offers significant advantages in overall time savings, reduction in material handing and avoidance of a manufacturing bottleneck.

The improvements in machinability and drillability of the X-11 alloy from the accelerated in-mold heat treatment is demonstrated in a drilling test that is a sensitive measure of both machinability and drillability. In this test, holes approximately 4 mm (0.156 in.) in diameter are drilled in a test block with M42 grade twist drills. Holes are drilled to a total depth of 38 mm (1.5 in.) in steps. The first step is 6 mm (0.25 in.) deep, the remaining steps are 3 mm (0.125 inc.). A rotational speed of 750 revolutions per minute is used with a freed rate of 51 mm (2.03 in.) per minute. The drill is lubricated with drilling oil. The drilling test results are the number of holes drilled before tool breakage, excessive wear, or excessive noise and vibration. The results are shown in the Table II below with high numbers being desired:

TABLE II

| Sample | Number of Holes Drilled |
|---|---|
| Alloy 86 | 79 |
| X-11 Sample #1 | 252 |
| X-11 Sample #2 | 217 |

Drills used in the X-11 samples had approximately 3 times the drill life as those used in drilling the Alloy 86. This is a significant and unexpected improvement in tool life which is due to the use of accelerated in-mold heat treatment of the X-11 alloy.

Material Performance

Corrosion resistance is measured using an electrochemical technique. A sample is tested in a very corrosive simulated paper mill white water solution under the following conditions: 35 mg/l thiosulfate ion, 400 mg/l chloride ion, 800 mg/l sulfate ion, with a pH of 4.1 and a temperature of 54° C. The corrosion resistance is measured by a value called the "margin of safety", with a high number being desired. Margins of safety are listed in the Table III below.

TABLE III

| Alloy | Margin of Safety (mV) |
|---|---|
| Alloy 86 (historical range from casting in service) | 560–1120 |
| X-11 | 920 |

No Alloy 86 has corroded in service out of more than 450 products produced. The X-11 alloy's margin of safety of 920 mV is near the top of the values experienced for Alloy 86. The X-11 alloy has equivalent to superior corrosion resistance in very corrosive white waters as the Alloy 86. This is unexpected and unique finding for an alloy such as the X-11 alloy which has been subjected to an accelerated in-mold heat treatment.

Resistance to fatigue crack growth is determined with a cyclically loaded compact tension specimen. A sample is tested in a very corrosive simulated paper mill white water solution under the following conditions: 50 mg/l thiosulfate ion, 200 mg/l chloride ion, 500 mg/l sulfate ion, with a pH of 3.5, a temperature of 50° C. at a frequency of 25 Hz. A characteristic called the threshold stress intensity range ($\Delta k_{th}$) is measured, and a critical crack size is calculated for a simplified mechanical analysis with high numbers being desired.

TABLE IV

| Alloy | $\Delta k_{th}$ MPa√m) | Critical Crack Size (mm) |
|---|---|---|
| Alloy 75 | 9 | 7 |
| Alloy 86 | 11 | 11 |
| X-11 | 10 | 9 |

Fatigue crack growth is a laboratory test that best ranks material resistance to corrosion-assisted cracking in service (Yeske, R., "Corrosion Fatigue Testing of Suction Roll Alloys", TPPI Journal, March 1988; Yeske, R., Revall, M., Thompson, C., "Corrosion-Assisted Cracking of Duplex Stainless Steels in Suction Roll Applications" TAPPI Journal, August 1994; ASM International, Metals Handbook, Ninth Edition, Vol. 16, pp. 686–690). The fatigue crack growth resistance of the X-11 alloy is between that of Alloy 75 and Alloy 86, both of which have provided excellent service performance in a variety of white waters. The X-11 alloy also provides excellent service.

The residual stresses are measured at the inside diameter (I.D.) of the machined cylinder. Alloy 86 with its slow furnace cooling heat treatment step has a nominal I.D. tensile residual stress of 24 MPa (3,500 psi). The alloy-11 which has been subjected to the accelerated in-mold heat treatment has a nominal I.D. tensile residual stress of 52 MPa (7,600 psi). A value less than 83 MPa (12,000 psi) is acceptable.

The present invention is a duplex stainless steel with unique combination of excellent service and manufacturing properties, especially enhanced machinability and drillability, that results from accelerated in-mold heat treatment.

We claim:

1. A highly pitting resistance ferritic-austenitic duplex cast stainless steel alloy which has been treated in a mold by an accelerated heat treatment such that harmful tensile residual stresses are controlled while retaining excellent machinability, ductility and corrosion resistance and essentially consists of, in weight percentage, C: 0.10% and below; Si: 1.5% and below; Mn: 2.0% and below; Cr: 25.0% to 27.0%; Ni: 5.0% to 7.5%; Cu: 1.5% to 3.5%; N: 0.15% and below; Mo: 0.5% and below; and the remaining portion Fe and unavoidable impurities.

2. The alloy of claim 1, wherein the accelerated in-mold heat treatment comprises controlling the rate of cast cooling in the temperature range of about 260° to about 1090° C. and keeping the temperature of the alloy in the mold within about 450° C. of the temperature outside of the mold.

3. The alloy of claim 1, wherein the percentage of Cr is about 26%, Ni is about 6.8% and Cu is about 2.0%.

4. A method for forming a highly pitting resistance ferritic-austenitic duplex cast stainless steel alloy which comprises treating the alloy in a mold with an accelerated heat treatment such that harmful tensile residual stresses are controlled while retaining excellent machinability, ductility and corrosion resistance, the alloy essentially consists of, in weight percentage, C: 0.10% and below; Si: 1.5% and below; Mn: 2.0% and below; Cr: 25.0% to 27.0%; Ni: 5.0% to 7.5%; Cu: 1.5% to 3.5%; N: 0.15% and below; Mo: 0.5% and below; and the remaining portion Fe and unavoidable impurities.

5. The method of claim 4, in which the accelerated in-mold heat treatment comprises controlling the rate of casting cooling in the temperature range of about 260° C. (500° F.) to about 1090° C. (2000° F.) and keeping the temperature of the inside diameter of the casting within about 250° C. (450° F.) of the temperature of the outside diameter of the casting.

6. The method of claim 5, in which the rate of cooling of the inside casting temperature and the outside casting temperature is controlled by adding heat to the inside of the casting.

7. The method of claim 5, in which the rate of cooling of the inside casting temperature and the outside casting temperature is controlled by using thermal insulation at ends of the casting.

8. The method of claim 5, in which the rate of cooling of the inside casting temperature and the outside casting temperature is controlled by speeding the cooling rate of the casting.

9. The method of claim 4, in which the alloy is treated with the accelerated heat treatment for about 20 hours or less.

* * * * *